US007963711B2

(12) United States Patent
Gueret

(10) Patent No.: US 7,963,711 B2
(45) Date of Patent: Jun. 21, 2011

(54) PACKAGING AND APPLICATOR DEVICE INCLUDING A MEMBER FOR RESHAPING AN APPLICATOR SURFACE THEREOF AND A METHOD OF RESHAPING AN APPLICATOR SURFACE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 12/801,362

(22) Filed: Jun. 4, 2010

(65) Prior Publication Data

US 2010/0244330 A1 Sep. 30, 2010

Related U.S. Application Data

(62) Division of application No. 12/213,158, filed on Jun. 16, 2008, now Pat. No. 7,748,919, which is a division of application No. 11/117,425, filed on Apr. 29, 2005, now abandoned.

(60) Provisional application No. 60/572,482, filed on May 20, 2004.

(30) Foreign Application Priority Data

Apr. 30, 2004 (FR) ..... 04 04674

(51) Int. Cl.
*A46B 11/08* (2006.01)

(52) U.S. Cl. ..... 401/2; 401/1; 401/52

(58) Field of Classification Search ..... 401/1, 2, 401/52, 98; 425/383, 384, 385, 386, 390
See application file for complete search history.

(56) References Cited

U.S. PATENT DOCUMENTS

| | | | | |
|---|---|---|---|---|
| 2,209,849 | A | 7/1940 | Seguin | |
| 2,580,092 | A | 12/1951 | Herbert et al. | |
| 3,166,792 | A * | 1/1965 | Goldfarb | 249/52 |
| 4,564,351 | A * | 1/1986 | LaRue et al. | 425/383 |
| 4,890,944 | A | 1/1990 | Cousins et al. | |
| 4,990,013 | A * | 2/1991 | Hejmanowski | 401/49 |
| 5,092,700 | A | 3/1992 | Susini et al. | |
| 5,102,248 | A | 4/1992 | Welschoff | |
| 5,151,575 | A | 9/1992 | Lilly | |
| 5,326,185 | A | 7/1994 | Dornbusch et al. | |
| 5,346,656 | A * | 9/1994 | Shafir | 264/489 |
| 5,957,604 | A | 9/1999 | Anderson | |

FOREIGN PATENT DOCUMENTS

GB 1 538 188 7/1976

* cited by examiner

*Primary Examiner* — David J Walczak
(74) *Attorney, Agent, or Firm* — Oliff & Berridge, PLC

(57) ABSTRACT

A packaging and applicator device comprising: a body; a block of fluidizable substance that is stationary relative to the body while the substance is in the solid state, said block of substance projecting beyond the body to define at least one surface serving as an applicator surface; and a reshaper member for reshaping the applicator surface, said reshaper member being positionable on the body to co-operate therewith to define at least one cavity into which the substance can flow when fluidized by supplying heat, the substance retaining the shape of the cavity when it returns to the solid state after cooling.

6 Claims, 4 Drawing Sheets

PACKAGING AND APPLICATOR DEVICE INCLUDING A MEMBER FOR RESHAPING AN APPLICATOR SURFACE THEREOF AND A METHOD OF RESHAPING AN APPLICATOR SURFACE

This Application is a Divisional of application Ser. No. 12/213,158, filed Jun. 16, 2008, which issued as U.S. Pat. No. 7,748,919 on Jul. 6, 2010, which in turn is a Divisional of application Ser. No. 11/117,425 (now abandoned) filed Apr. 29, 2005, which is a non provisional application which claims the benefit of French Application No. 04 04674 filed on Apr. 30, 2004 and U.S. Provisional Application No. 60/572,482 filed on May 20, 2004. The disclosures of the prior applications are hereby incorporated by reference herein in their entirety.

BACKGROUND

The present invention relates to packaging and applicator devices, particularly but not exclusively for making up the skin, the mucous membranes, the nails, or hair.

Known devices for packaging and dispensing lipsticks or deodorants comprise a body housing a stick of substance and a mechanism for displacing it relative to the body to compensate for wear as it is used up. The drive mechanism is relatively expensive and, furthermore, the applicator surface never regains its original shape.

Makeup pencils are also known that comprise a wood or plastics body into which the substance is cast to form the "lead". During use, the "lead" becomes worn and the user must resort to a pencil sharpener to reshape it, which risks breaking the "lead" or weakening it in subsequent use.

Known blushers, lip colors, or eye shadows that are slightly domed for direct application to the skin suffer from the disadvantage of losing their initial shape relatively rapidly; once shape has been lost, application can no longer be as accurate as desired.

SUMMARY

The invention aims to overcome the above disadvantages.

In one of its aspects, the invention provides a packaging and applicator device comprising:

a body;

a block of fluidizable substance that is stationary relative to the body while the substance is in the solid state, said block of substance projecting beyond the body to define at least one surface serving as an applicator surface; and a reshaper member for reshaping the applicator surface, said reshaper member being positionable on the body to cooperate therewith to define at least one cavity into which the substance can flow when fluidized by supplying heat, the substance being capable of retaining the shape of the cavity when it returns to the solid state after cooling.

The term "fluidizable" should not be construed in its narrow sense, and encompasses any possibility of softening a substance under the effect of heat which is sufficient to allow it to flow into said cavity to reshape its applicator surface.

The term "solid state" means the state of the substance at ambient temperature (about 20° C.) under normal conditions of use.

The term "stationary relative to the body" means that the device has no drive mechanism for displacing the block of substance axially relative to the body when the substance is at ambient temperature such as, for example, known screw mechanisms in certain deodorants or lipsticks.

Advantageously, the reshaper member is arranged to allow the body of the device to remain vertical while the substance is flowing into the cavity. In particular, the reshaper member may be arranged to be capable of resting in a stable manner on a horizontal flat surface.

In an exemplary embodiment, the reshaper member is arranged to engage on the outside of the body. As an example, the reshaper member may also act as a member for closing the body, at its applicator surface end, to protect it when not in use. The reshaper member may optionally be configured to be fastened on the body on its end opposite from the applicator surface which can, for example, reduce the risk of losing the reshaper member while the substance is being applied.

The body has an inside surface in contact with the substance and said inside surface may comprise at least one portion in relief which opposes slipping of the solid substance inside the body. Said portion in relief may comprise a constriction or serration, for example.

The body may also have an inside cross section that tapers or flares towards the applicator surface.

The reshaper member may comprise at least two housings configured to form applicator surfaces having different shapes, depending on which housing the user selects to receive the body of the device. This may afford the user the opportunity to choose between a plurality of applicator surfaces, depending on the type of makeup being applied.

The reshaper member may comprise one housing to reshape the applicator surface and another housing to receive the body in a closed configuration thereof, said other housing not acting to reshape the applicator surface.

If appropriate, the body may include more than one opening through which the substance can flow during reshaping of the applicator surface.

The body may also include at least one eccentric opening through which the substance can flow during reshaping of the applicator surface.

If necessary, the body of the device may be packaged in a package such as a case having a portion that can act as the reshaper member.

Preferably, the quantity of substance contained in the body of the device is sufficient to allow at least one reshaping operation, and preferably at least two reshaping operations.

The temperature to which the substance is heated for reshaping its applicator surface may in particular depend on the nature of the substance and the rate at which its missing portion can be filled in the cavity of the reshaper member.

As an example, the substance may have an anhydrous formulation, which behaves reversibly as a function of temperature and it may contain at least one compound which can coagulate, plasticize, or harden on returning to ambient temperature.

As an example, the substance may be a blusher, a lipstick, or an eye makeup substance, this list being non-limiting; the invention is applicable to any cosmetic or dermatological care product.

The body of the device and the reshaper member can withstand the rise in temperature necessary to fluidize the substance and reshape the applicator surface; for example, they may withstand a temperature of about 120° C. in the absence of mechanical stresses.

Preferably, the reshaper member is made so as to facilitate unmolding of the applicator surface. The material from which the reshaper member is made may be provided to this end. The reshaper member may, for example, be made of polypropylene (filled or otherwise), polystyrene, polyamide, in particular Nylon®, polyethylene terephthalate (PET), elastomers, or silicones, this list being non-limiting.

It may also be made of at least two different materials, one of which may be elastically deformable. The reshaper member may, for example, be made with a bottom formed from an elastically deformable material, for example silicone, to facilitate unmolding, with the remainder being formed from a non elastomeric material, for example polypropylene.

The reshaper member may include a vent to facilitate filling the cavity.

Advantageously, opposite the reshaper member, the body includes an opening to allow pressure equalization.

In a further aspect, the invention provides a method of reshaping an applicator surface in a device comprising:

a body;

a block of liquefiable substance contained in the solid state in the body, said block of substance projecting beyond the body to define at least one surface serving for application; and a reshaper member for reshaping the applicator surface, said reshaper member being positionable on the body to cooperate therewith to define at least one cavity;

in which method, after the block of substance has been used at least once, the reshaper member is positioned on the body and is heated to allow the substance to flow into the cavity, the substance being capable of retaining the shape of the cavity on resuming the solid state after cooling.

The substance may be heated by exposing it to microwave radiation, for example for a period in the range 10 seconds to 5 minutes, or to the heat released by an electrical resistance. The substance may be heated to a temperature of more than 80° C., for example.

The cavity into which the substance is cast may be selected from a number of cavities as a function of the desired shape with which the applicator surface is to be endowed.

BRIEF DESCRIPTION OF THE DRAWINGS

The invention will be better understood from the following detailed description of non limiting embodiments thereof and from the accompanying drawing in which.

DETAILED DESCRIPTION OF EMBODIMENTS

Figure 1:
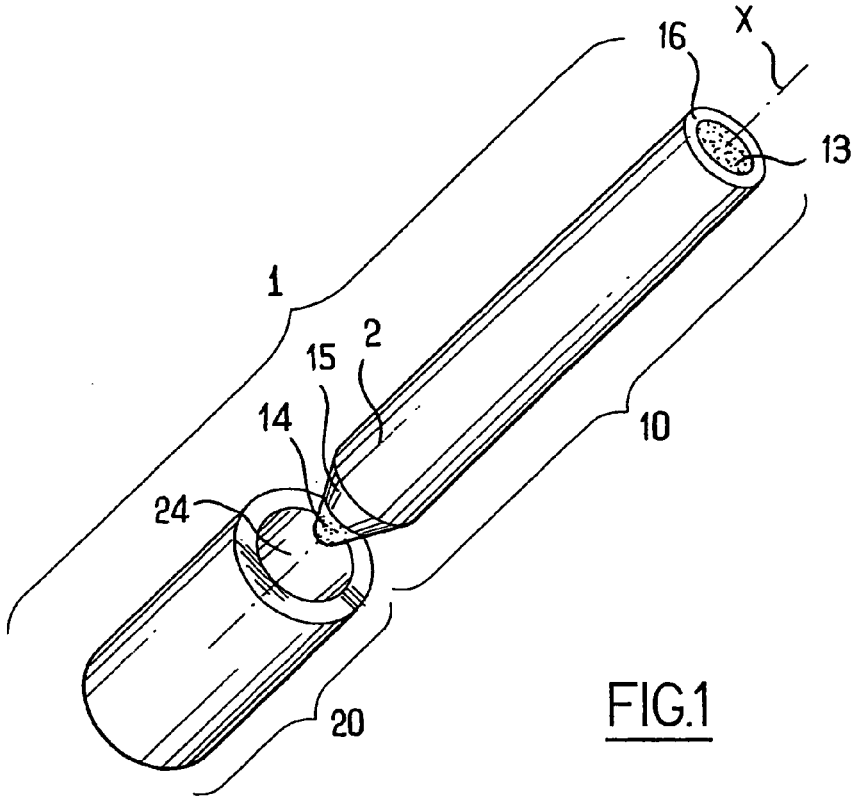
FIG. 1 is a diagrammatic perspective view showing an example of a packaging and applicator device in accordance with the invention.
Figure 2:
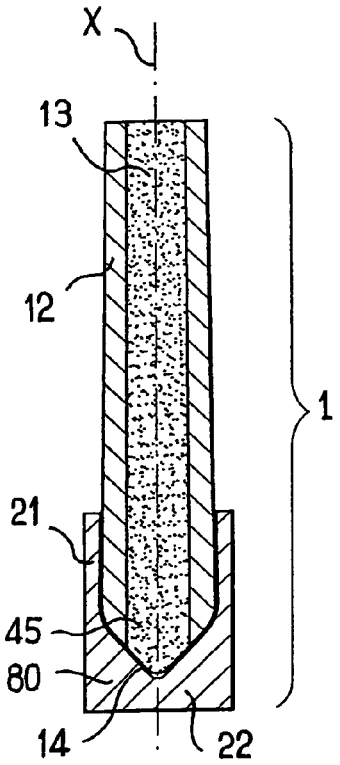
FIGS. 2 to 4 show reshaping of the applicator surface of the device of FIG. 1.

The packaging and applicator device 1 shown in FIG. 1 comprises an applicator member 10 and a reshaper member 20. The applicator member 10 comprises a body 12 which is elongate along a longitudinal axis X in the example under consideration, and a block of fluidizable substance 13 extending beyond one end of the body 12 to define an applicator surface 14.

In the example under consideration, the applicator member 10 constitutes a pencil, and prior to its first use, the applicator surface 14 has a generally pointed shape.

The end 15 of the body 12 adjacent to the applicator surface 14 is substantially conical, converging towards the tip. The body 12 in the example under consideration is open at its opposite end 16. As an example, the substance may be cast into the body 12 via this end 16 during manufacture of the device.

In the example under consideration, the reshaper member 20 is in the general shape of a cap comprising a tubular skirt 21 which connects at its lower end to a bottom portion 22.

In the example under consideration, the skirt 21 is cylindrical and centered about the axis X, its inside diameter being adapted to the outside diameter of the body 12 so that it fits thereon with a small amount of interference.

The reshaper member 20 defines a cavity 24 defined radially by the skirt 21 and has a bottom 25 with a shape corresponding to that with which the applicator surface 14 is to be endowed when reshaped.

Before first use, the applicator member 10 may have an applicator surface 14 the shape of which corresponds to that of the bottom 25 of the cavity 24, the substance 13 advantageously being cast into the body 12 while the reshaper member 20 was in position thereon.

Figure 3:
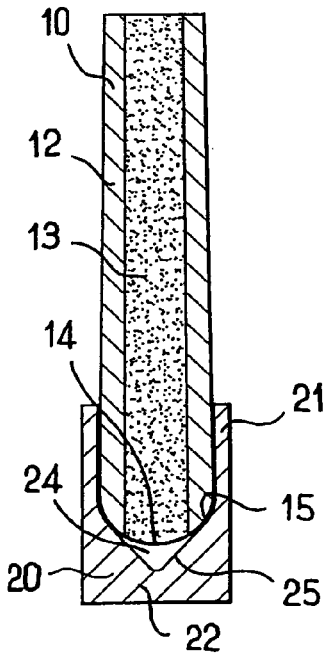

After being used one or more times, the applicator surface becomes worn due to transfer of substance onto the treated surface and may, for example, have the flattened shape shown in FIG. 3. To reshape the applicator surface 14, the user inserts the applicator member 10 into the reshaper member 20 until the end 15 axially abuts against it, as shown in FIG. 3. A void remains above the bottom 25 of the cavity 24.

The user then heats the assembly, disposed vertically with the reshaper member lowermost, for example by placing it in a microwave oven. The duration of heating depends on a several of factors such as the power of the oven, and the natures of the body of the device, and of the substance.

The substance may then be heated to a temperature higher than about 80° C., for example. The body 12 of the applicator member and the reshaper member 20 are capable of withstanding the temperature to which the substance is heated.

The applicator member 10 and the reshaper member 20 may be made so as to be compatible with use in a microwave oven, and should then not include any metal or metallization which could deteriorate or damage the oven used.

Figure 4:
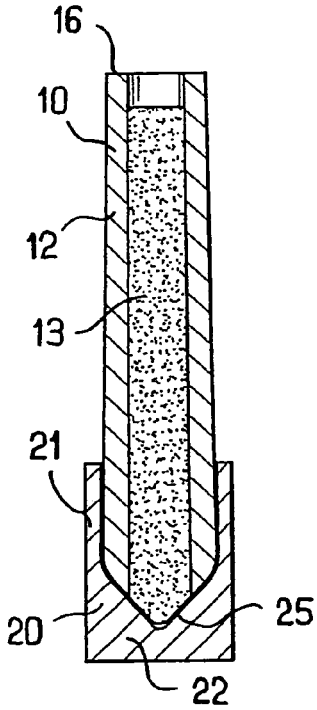

The properties of the substance are such that, when heated to a sufficient temperature, it can fluidize and flow under gravity into the cavity to match the shape of its bottom 25, as shown in FIG. 4.

The user then allows the substance 13 to cool, to allow it to solidify. Cooling may, for example, be accomplished in air or by placing the assembly in a refrigerator or freezer. It can be seen in FIG. 4 that the level of the substance inside the body 12 drops due to outflow thereof into the cavity 24 during reshaping of the applicator surface 14, outflow being facilitated by the air pressure equalization made possible by the body 12 because its end 16 is open.

Once the substance has resumed its solid state, the user can once again use the applicator member 10, the applicator surface 14 having regained a suitable shape, corresponding to that of the bottom 25.

The operation may be repeated as many times as allowed by the quantity of substance contained in the body 12. The maximum volume of substance that flows out on each reshaping of the applicator surface 14 into the cavity 24 may, for example, correspond to less than half of the initial volume of the block of substance 13, preferably less than a third, a quarter, a fifth, or a tenth thereof.

Each time the applicator surface 14 is reshaped, the heating of the substance, if sufficient, may exert a germicidal or bactericidal action on the applicator surface 14, which may serve to reduce or even dispense with preservatives in the substance.

To reduce the risk of the block of substance 13 slipping relative to the body 12 when the substance is in the solid state, the inside surface of the body 12 may be provided with at least one portion in relief, which may be a hollow or a projection, as shown in FIGS. 5 and 6 and 22 to 24.

Figure 5:
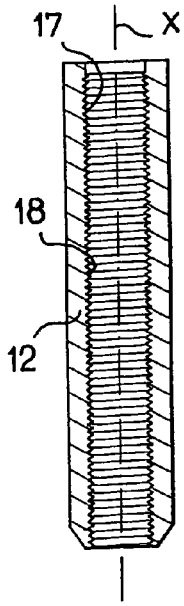
FIGS. 5 to 7 are diagrammatic longitudinal section views showing variations of the device body.
Figure 6:
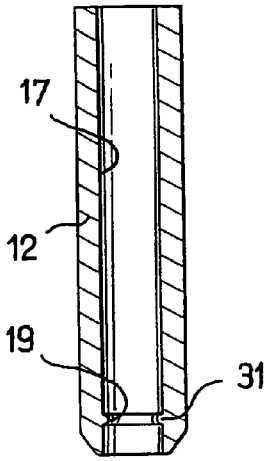
Figure 22:
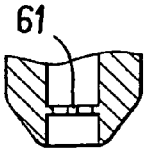
FIGS. 22 to 24 show the portions in relief for retaining substance in the body, respectively in the form of a screen, a helical thread, and a porous structure.
Figure 23:
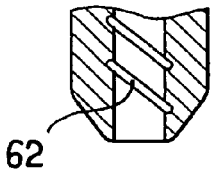
Figure 24:
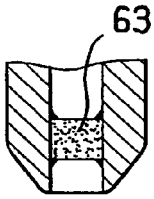

In FIG. 5, the inside surface 17 is provided with serrations 18 extending across the longitudinal axis X; in FIG. 6, the inside surface 17 includes a constriction 19 constituted, for example, by an annular bead 31 which projects radially inwards. Clearly, the scope of the invention encompasses making other portions in portion in relief. As an example, at least one screen 61 may be made, as shown in FIG. 22, or a helical thread 62, as shown in FIG. 23, or a porous structure 62 may be fitted in the body, as shown in FIG. 24. For example, this porous structure which may be a foam or a sponge, and it may occupy a greater or lesser amount of space inside the body, depending, for example, on the viscosity of the substance. The inside surface may also be made with suitable roughness.

Figure 7:
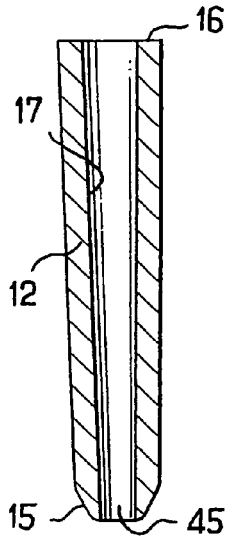

It is also possible to give the inside surface 17 a cross section that is not constant, for example a cross section that decreases towards the end 15, as shown in FIG. 7, or conversely, increases towards the end 15 (variation not shown).

If appropriate, the inside surface 17 may be made with a cross section that increases or decreases towards one end of the body 12, and that is also provided with at least one portion in relief to encourage retention of the substance.

Figure 8:
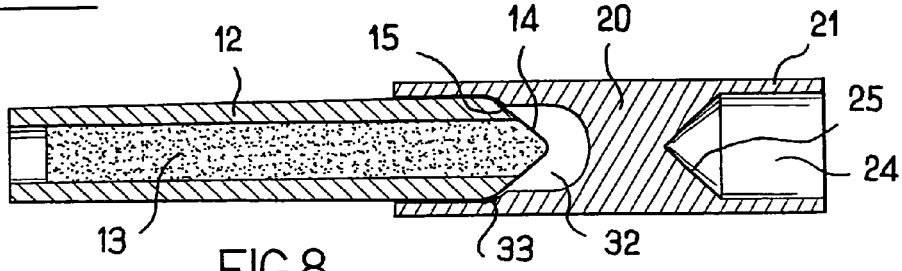
FIG. 8 is a diagrammatic longitudinal section view showing a device in which the reshaper member may also act as the closure cap.

The reshaper member 20 may act as a closure cap to protect the applicator surface 14 when not in use, as applies to the example shown in FIGS. 1 to 4. In a variation, the reshaper member 20 may include a second housing 32 that differs from the housing defining the cavity 24 and that serves only to receive the body 12 when not in use, the cavity 24 being the only cavity suitable for reshaping the applicator surface 14. In this case, the housing 32 may, for example, be sufficiently wide for the reshaper member 20 not to come into contact with the applicator surface 14, as shown in FIG. 8, the end 15 of the body 12 bearing axially, for example, against a shoulder 33 of the housing 32.

Figure 9:
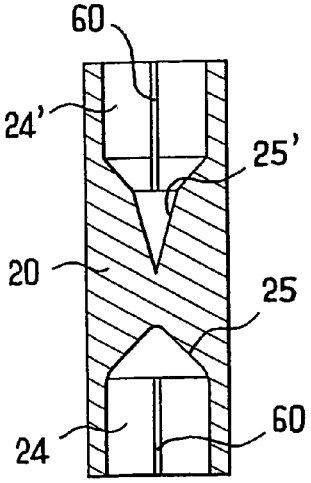
FIG. 9 shows, in isolation, a reshaper member for reshaping the applicator surface into two predetermined shapes, as selected by the user.

If appropriate, as shown in FIG. 9, the reshaper member 20 may define two cavities 24 and 24' having respective bottoms 25 and 25' that are arranged to reshape the applicator surface 14 into different shapes, for example one shape which is more pointed than the other. The user can then select which cavity 24 or 24' which is suitable for the desired application in order, for example, to deposit substance on a broad surface or, in contrast, to make an outline.

In the example of FIG. 9, the cavities 24 and 24' open in opposite directions, but such a configuration is not the only possibility.

FIG. 9 also shows that the reshaper member may be made with at least one vent facilitating evacuation of air contained in the cavity while it is being filled. That vent may, for example, be in the form of a groove 60.

Figure 10:
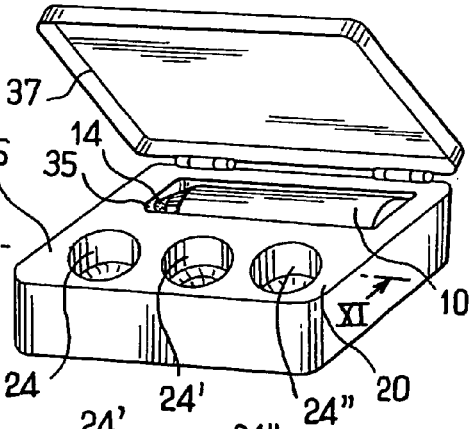
FIG. 10 is a diagram showing a package that allows the applicator surface to be reshaped.
Figure 11:
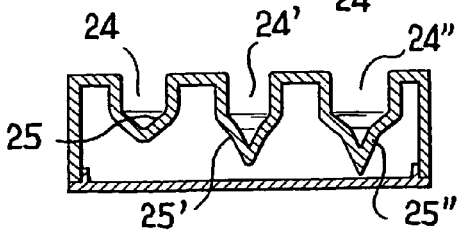
FIG. 11 is a diagram of the package in section on XI-XI of FIG. 10.

The reshaper member 20 may then, if appropriate, and as shown in FIGS. 10 and 11, be in the form of a package comprising a closing lid 37 and a bottom portion 36 with, for example, a housing 35 to receive the applicator member 10 horizontally when not in use and defining at least one cavity, for example three cavities 24, 24' and 24" in the example shown, to receive the applicator member 10 vertically during reshaping of the applicator surface 14.

The cavities 24, 24' and 24" have respective bottoms 25, 25' and 25" having different shapes, to allow different applicator surfaces to be formed, for example points with different tapers at the end of the applicator member.

Figure 12:
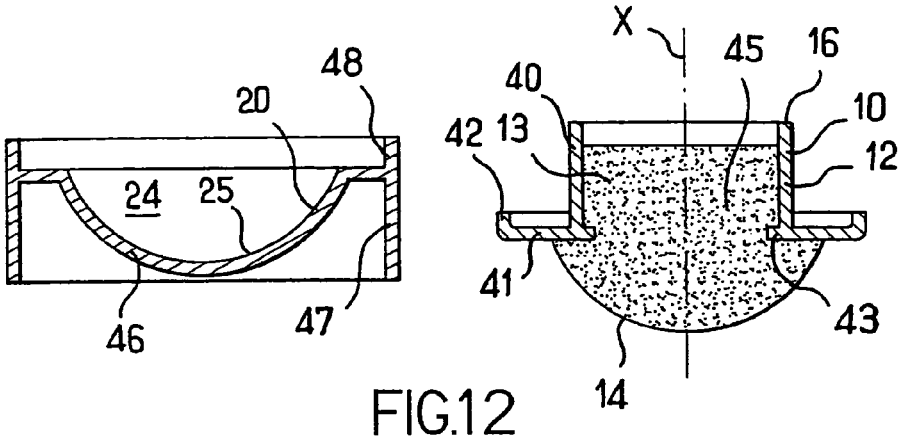
FIG. 12 shows another example of a packaging and applicator device in accordance with the invention.

The applicator member 10 may differ from that of a pencil; FIG. 12 shows a variation in which the applicator member 10 has a broader applicator surface 14 than in the example of FIG. 1.

The body 12 of the applicator member 10 in this example comprises a tubular portion 40 that is connected at its bottom to a flange 41 which is directed radially outwardly. In the example under consideration, the flange 41 is provided with an edge 42 which is directed towards the end 16 of the applicator member remote from the applicator surface 14.

In the example shown, the shape of the applicator surface is substantially part spherical with a periphery which is, for example, substantially half the width of the flange 41. A rib 43 extends the flange 41 radially inwards from the skirt 40 and forms a portion in relief which improves the grip of the block of substance 13 in the solid state in the body 12.

The body 12 is shown as it is when obtained as a one-piece plastics molding. Clearly, the scope of the present invention encompasses the body 12 being made by assembling a plurality of elements which have been made independently.

The reshaper member 20 comprises a wall 46 in the form of a cup, defining the cavity 24 having a bottom 25 of the shape that is to be restored to the applicator surface 14.

Figure 14:
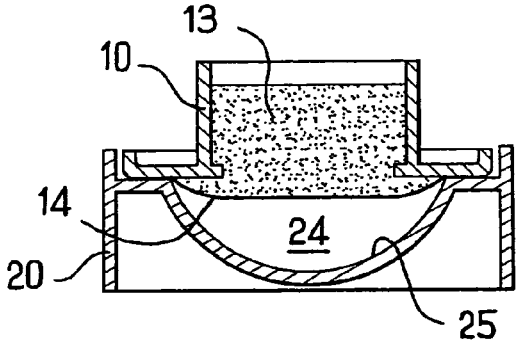
FIG. 14 shows the device before reshaping its applicator surface.

The periphery of the wall 46 is connected to a tubular skirt 47 via which the reshaper member may rest on a horizontal surface, with the axis of the cavity 24 vertical. The skirt 47 is extended upwards by a rib 48 which, by cooperating with the edge 42, can center the applicator member 10 on the reshaper member 20, as shown in FIG. 14.

Figure 13:
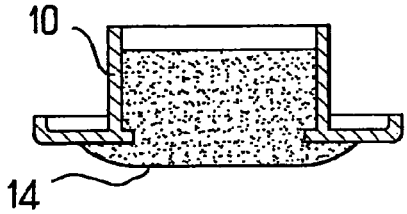
FIG. 13 illustrates wear on the applicator surface.
Figure 15:
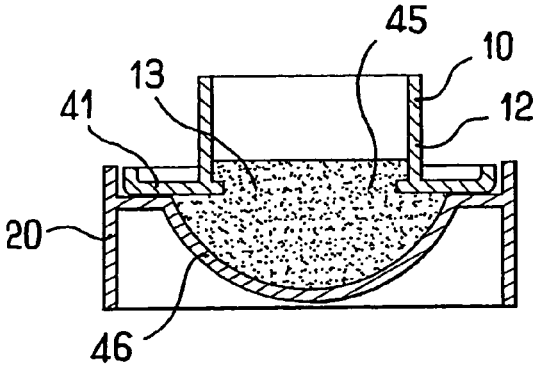
FIG. 15 shows the device of FIG. 14 after reshaping its applicator surface.

During use, the applicator surface 14 loses its initial shape, as shown in FIG. 13. To reshape the applicator surface 14, the applicator member 10 is positioned over the reshaper member 20, as shown in FIG. 14, then the assembly is heated, for example in a microwave oven, to allow the substance 13 to fluidize and flow into the bottom of the cavity 24. The applicator surface 14 may become reshaped in contact with the bottom 25 of the cavity 24, as shown in FIG. 15. It can be seen in this figure that the level of substance in the body 12 is reduced following reshaping. The block of substance 13 then sets on cooling and thus retains the shape of the bottom 25 of the cavity 24.

Contact between the flange 41 and the wall 46 may contribute to preventing substance from leaking out while it is in the fluid state. Clearly, specific sealing means could be provided, such as at least one sealing lip or gasket formed of a particular material, for example an elastomer.

The applicator member 10 may be made in a variety of manners within the scope of the invention, as can the reshaper member 20.

Figure 16:
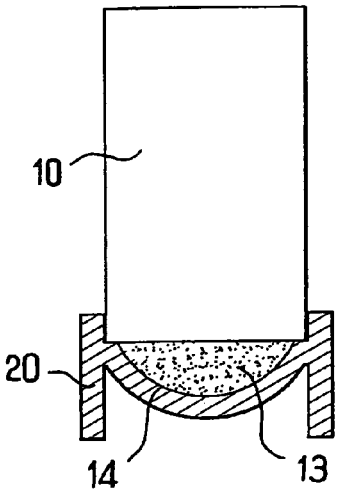
FIGS. 16 to 18 are diagrams showing other examples of packaging and applicator devices in accordance with the invention.

As an example, FIG. 16 shows an applicator member 10 intended for application to a broad surface, for example to the body, the applicator surface 14 possibly having a domed oblong shape, for example.

Figure 17:
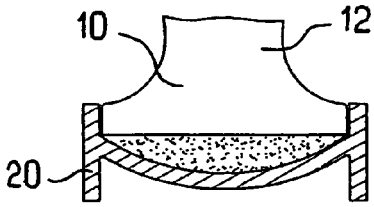

In the example shown in FIG. 17, the body 12 of the applicator member 10 may be relatively short, if the substance is a blusher, for example.

Figure 18:
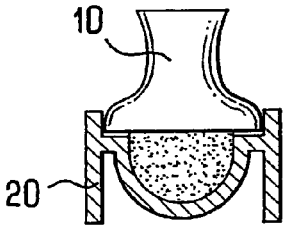

In the example shown in FIG. 18, the substance is, for example, intended for application to the lips.

Figure 19:
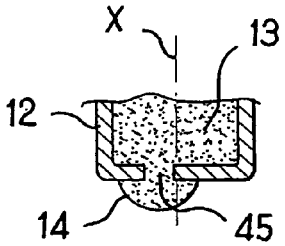
FIG. 19 shows the possibility of making the body of the device with an eccentric opening for substance outflow.

The body 12 may include a single opening 45 through which the substance 13 can flow out when it is in the fluid state, to allow the applicator surface 14 to be reshaped. Said opening 45 may be centered on a longitudinal axis of the applicator member, said axis possibly being an axis of symmetry. In a variation, as shown in FIG. 19, the opening 45 may be eccentric with respect to the longitudinal axis of the body 12.

Figure 20:
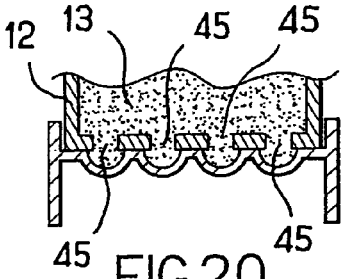
FIG. 20 shows the possibility of making the body of the device with a plurality of openings for substance outflow.

The applicator member 10 may also include a plurality of openings 45 through which the substance 13 may flow out during reshaping of the applicator surface 14, as shown in FIG. 20.

Figure 21:
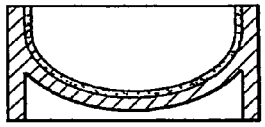
FIG. 21 shows the possibility of making the reshaper member in at least two different materials.

As shown in FIG. 21, the reshaper member may also be made of at least two materials with different hardnesses, for example an elastomer and a non elastomer, to facilitate unmolding.

One of the materials may define at least the bottom of the cavity, while the other material constitutes the remainder of the reshaper member.

Clearly, the invention is not limited to the embodiments described above; in particular, the characteristics of the various embodiments described may be combined together.

The substance may be heated to fluidize it in a manner other than placing the applicator member in a microwave oven, for example by exposing the substance to the heat released by an electrical resistance. Such an electrical resistance may be external to the applicator member or, if appropriate, may be integrated in the applicator member. The reshaper member may then comprise a source of electrical energy and means for establishing electrical contact with the resistance carried by the applicator member, so that positioning the applicator member on the reshaper member automatically causes an electric current to flow in the resistance, heating the substance and reshaping the applicator surface.

Throughout the description, the expression "comprising a" should be understood to be synonymous with "comprising at least one", unless otherwise indicated.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of reshaping an applicator surface packaging and applicator device comprising:

an applicator member comprising:

a body;

a block of fluidizable substance that is stationary relative to the body while the substance is in a solid state, said block of substance projecting beyond the body to define at least one surface comprising an applicator surface; and a reshaper member for reshaping the applicator surface, said reshaper member being positionable on the body to co-operate therewith to define at least one cavity;

the method comprising:

after the block of substance has been used at least once, positioning the reshaper member on the body to define the at least one cavity;

heating the substance to allow the substance to flow into the at least one cavity; and allowing the substance to cool with the reshaper member positioned on the body, the substance retaining a shape of the at least one cavity upon return to the solid state after cooling.

2. A method according to claim 1, wherein heating the substance comprises exposing the substance to microwave radiation.

3. A method according to claim 1, wherein heating the substance comprises exposing the substance to heat generated by an electrical resistance.

4. A method according to claim 1, wherein allowing the substance to cool comprises placing the body in one of a refrigerator and a freezer.

5. A method according to claim 1, wherein the substance is heated to a temperature higher than about 80° C.

6. A method according to claim 1, wherein the reshaper member is positionable on the body to co-operate therewith to selectably define a plurality of cavities, positioning of the reshaper member on the body comprising selecting one of the plurality of cavities to define the cavity into which the substance flows upon heating.

* * * * *